US008561817B1

(12) United States Patent
Allen

(10) Patent No.: US 8,561,817 B1
(45) Date of Patent: Oct. 22, 2013

(54) WINGED PUSHER

(75) Inventor: Michael Christopher Allen, Mamaroneck, NY (US)

(73) Assignee: POP Displays USA LLC, Yonkers, NY (US)

( * ) Notice: Subject to any disclaimer, the term of this patent is extended or adjusted under 35 U.S.C. 154(b) by 271 days.

(21) Appl. No.: 12/714,348

(22) Filed: Feb. 26, 2010

Related U.S. Application Data

(60) Provisional application No. 61/155,802, filed on Feb. 26, 2009.

(51) Int. Cl.
*A47F 7/00* (2006.01)
*A47F 1/04* (2006.01)

(52) U.S. Cl.
USPC ..... 211/59.3

(58) Field of Classification Search
USPC ..... 211/59.3, 184, 59.2, 183; 312/61, 71; 221/227, 255, 279
See application file for complete search history.

(56) References Cited

U.S. PATENT DOCUMENTS 4,351,439 A * 9/1982 Taylor ..... 211/59.3
5,190,186 A 3/1993 Yablans et al.
5,265,738 A * 11/1993 Yablans et al. ..... 211/59.3
5,542,552 A 8/1996 Yablans et al.
5,685,664 A * 11/1997 Parham et al. ..... 403/393
6,142,317 A * 11/2000 Merl ..... 211/59.3
6,648,151 B2 * 11/2003 Battaglia et al. ..... 211/59.2
7,032,761 B2 * 4/2006 Nagel ..... 211/59.3
7,140,499 B2 * 11/2006 Burke ..... 211/59.3
7,152,536 B2 12/2006 Hardy
7,195,123 B2 * 3/2007 Roslof et al. ..... 211/59.3
7,451,881 B2 * 11/2008 Hardy et al. ..... 211/59.2
7,681,744 B2 * 3/2010 Johnson ..... 211/59.3
2004/0245197 A1 * 12/2004 McElvaney ..... 211/184
2006/0273053 A1 * 12/2006 Roslof et al. ..... 211/59.3
2007/0151938 A1 * 7/2007 Burke ..... 211/59.3
2007/0170127 A1 * 7/2007 Johnson ..... 211/59.3
2011/0017684 A1 * 1/2011 Nagel et al. ..... 211/59.3
2011/0210086 A1 * 9/2011 Ciesick ..... 211/59.3
2011/0215061 A1 * 9/2011 Niederhuefner et al. .... 211/59.3
2012/0048817 A1 * 3/2012 Green et al. ..... 211/59.3

* cited by examiner

*Primary Examiner* — Jennifer E Novosad
(74) *Attorney, Agent, or Firm* — Collard & Roe, P.C.; Christopher B. Garvey

(57) ABSTRACT

A pusher system, for merchandising products, such as plates. The pusher system 2 has a tray 6. The tray 6 has a floor 10. A pair of wings are affixed to both sides of the floor, to hold products centered on the tray. A pusher 40 is slidably mounted on the floor. A spring biases the pusher customerward, thereby propelling the products customerward to barrier, which holds the products, which are forced against the barrier by the pusher.

12 Claims, 14 Drawing Sheets

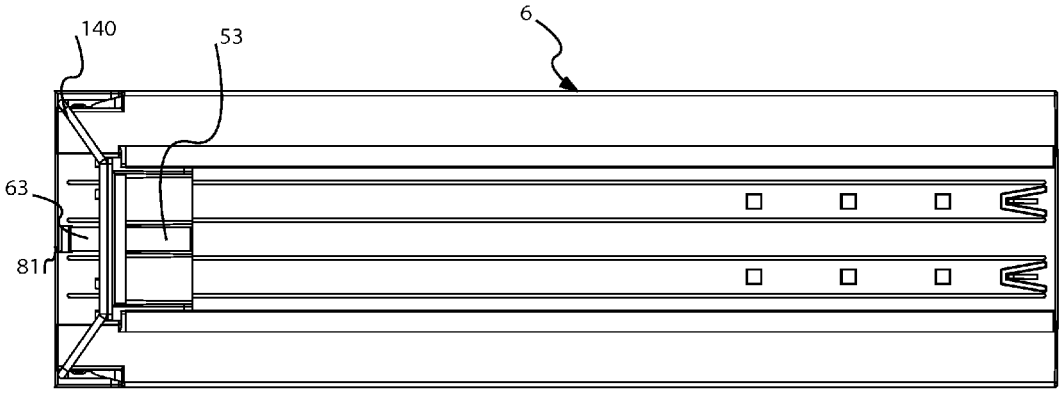
FIG. 5
FIG. 5A
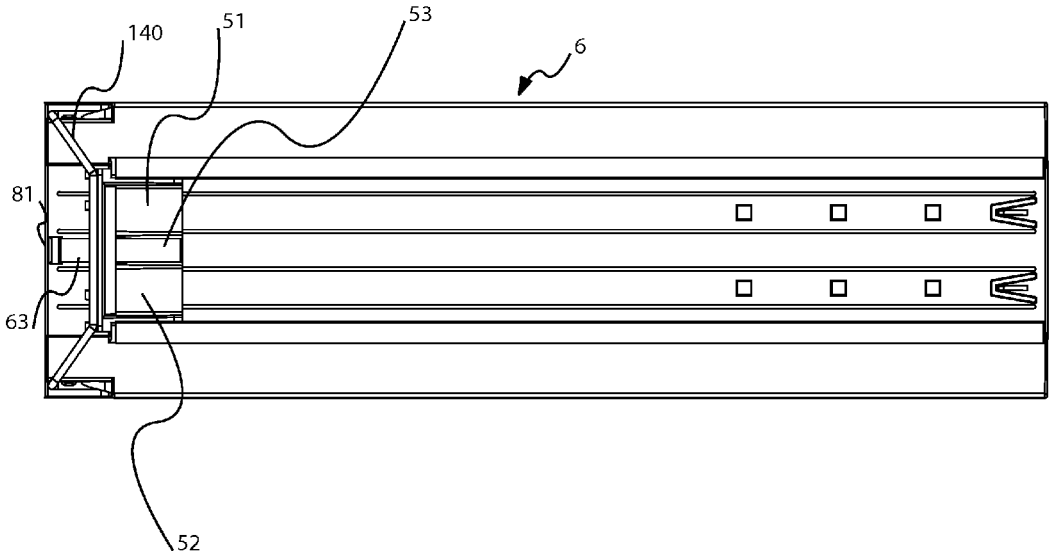

WINGED PUSHER

This Non-Provisional Application takes benefit of a prior Provisional Application 61/155,802, filed Feb. 26, 2009.

A pusher system has a spring-powered pusher-track tray for merchandising objects such as plates, without a back rail or vertical divider. The tray has a floor, having affixed to both sides a pair of wings to hold product centered on the tray.

BRIEF DESCRIPTION OF THE DRAWINGS

FIG. 5 is a top plan view thereof.

FIG. 5A is a top plan view of another embodiment having three springs.

DETAILED DESCRIPTION OF THE DRAWINGS

Figure 7:
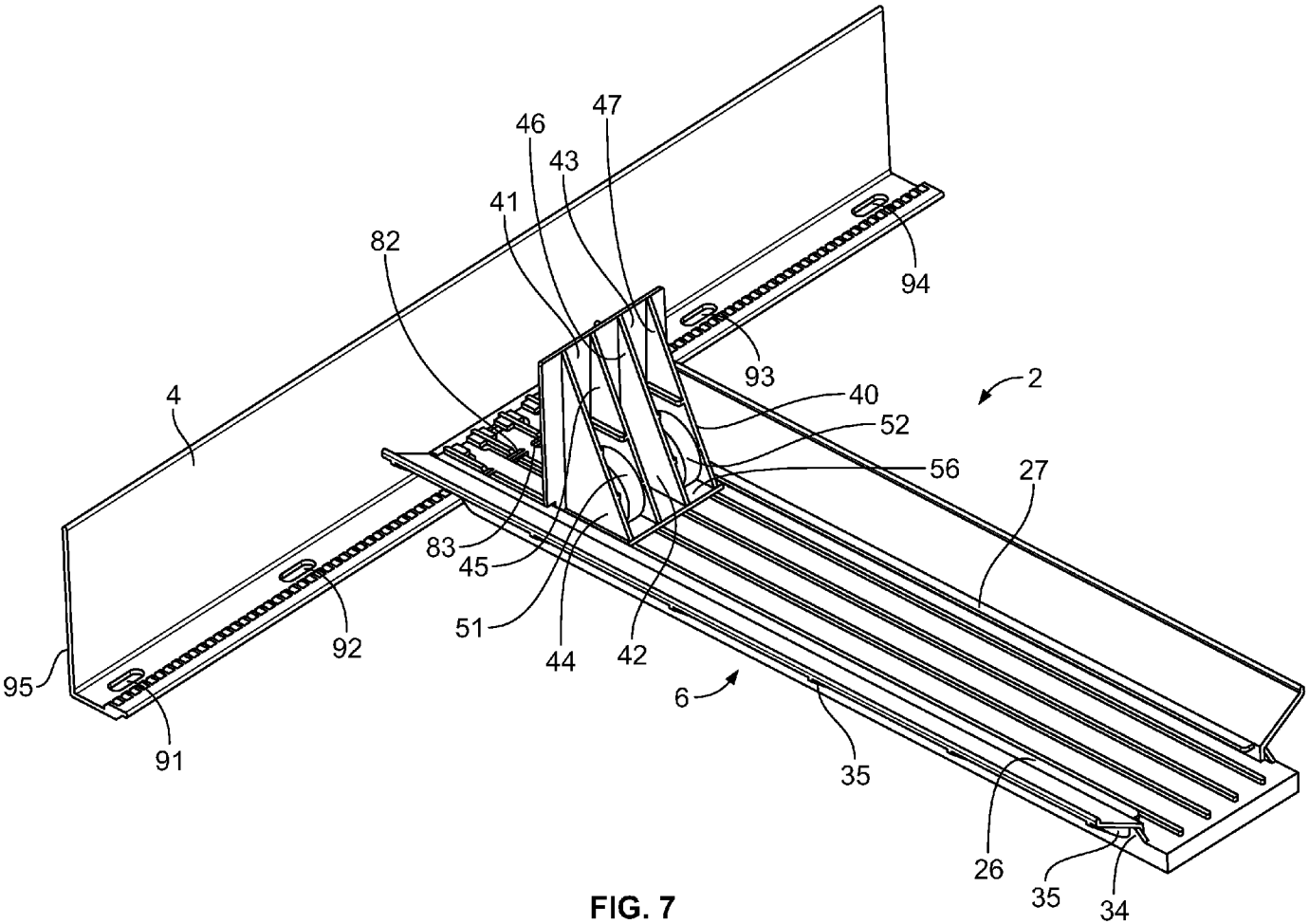
FIG. 7 is an oblique upper right rear view of another embodiment of the present invention.

Elements of the system 2, include the following:

As in FIG. 7, the pusher system, generally designated 2, has a clear front rail 4 and spring-powered pusher-track tray 6 for merchandising objects such as plates, without a back rail or integral divider.

Figure 4:
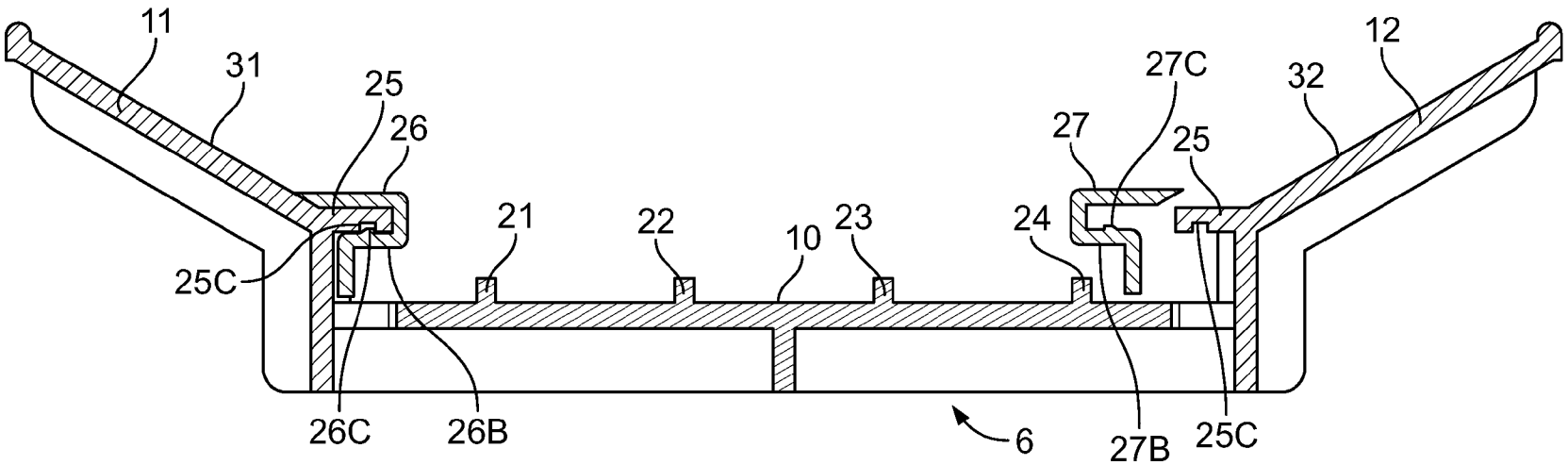
FIG. 4 is a rear elevation, in section, of a tray with snap-in tracks.

FIG. 4 shows, in rear elevation, a profile of tray 6. Tray 6 comprises floor 10, having affixed to both sides a pair of wings 11, 12. Floor 10 comprises four floor rails 21, 22, 23, 24.

Figure 2:
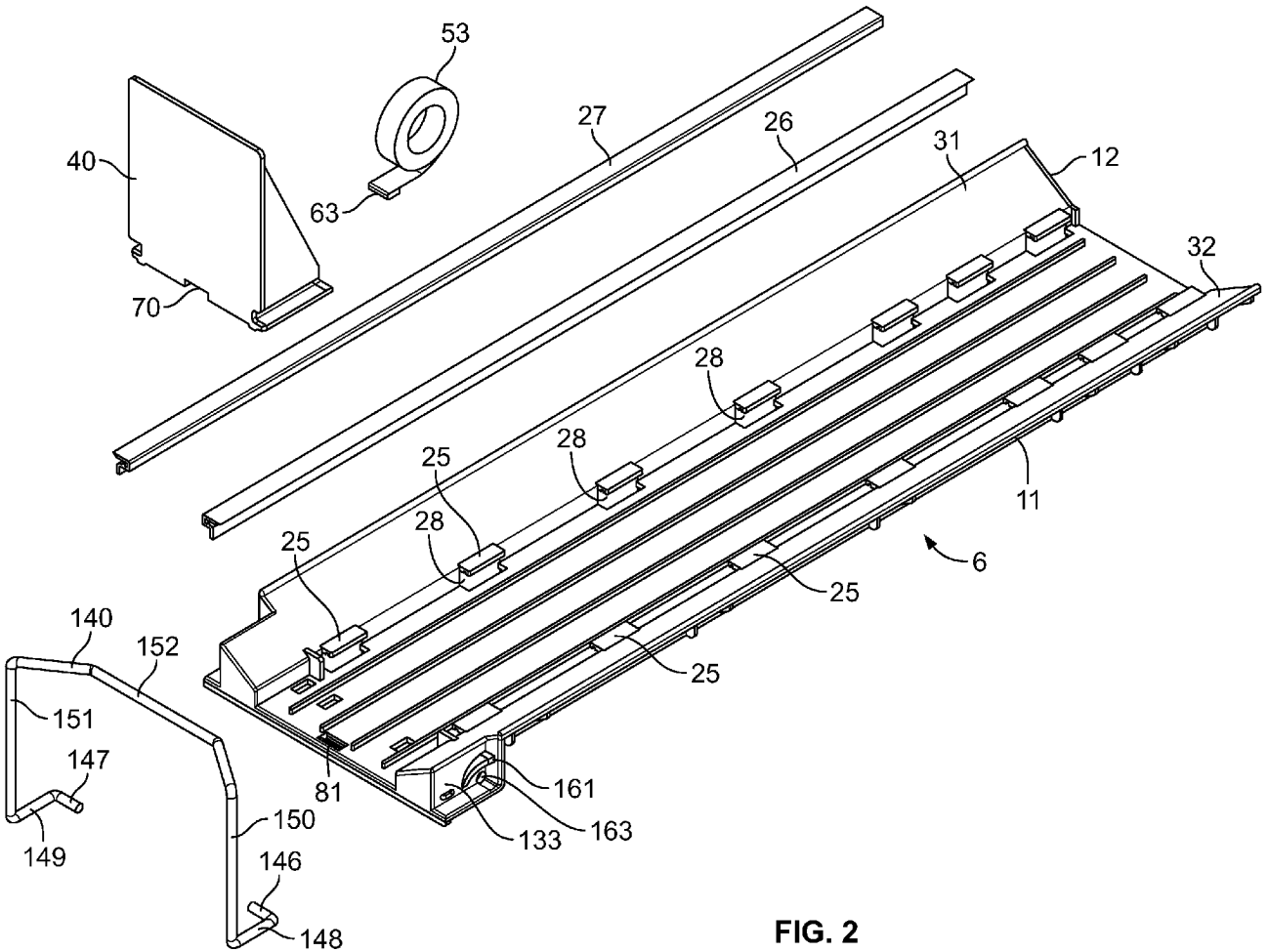
FIG. 2 is a similar view thereof, exploded to view the parts.

Wings 11-12, comprise a plurality of rail-mount tabs 25 shown also in FIG. 2. Tabs 25 serve to mount hold-down channel 26 to wing 11, and hold-down channel 27 to wing 12. FIG. 4 shows channel 27 in position to snap onto tabs 25, and channel 27 snapped on to tabs 25. Ridges 26C-27C inside channels 26-27 cooperate with grooves 25C in the undersides of tabs 25, and with the elastic deformability of the materials, to snap-hold the channels 26-27 to the tabs 25.

Openings 28 facilitate the formation of tabs 25 in the process of molding tray 6. This much simplifies the location of the continuous undersurfaces 26B-27B from molded parts above floor 10 to retain pusher 40.

Each of the channels 25 & 27 each comprises a protruding undersurface 26B-27B for slidably retaining the pusher 40 to the floor 10.

Figure 3:
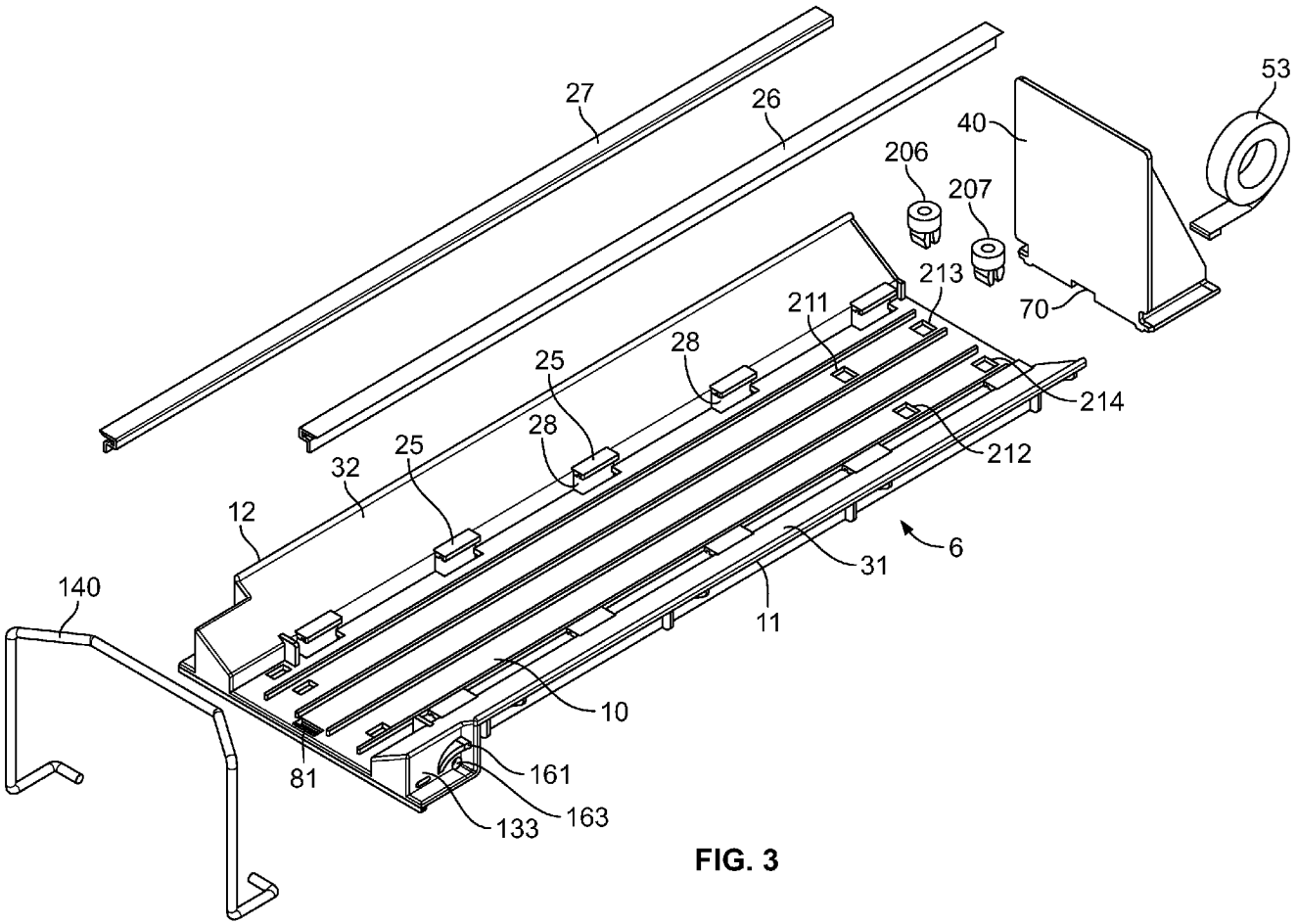
FIG. 3 is a similar view of another embodiment.

FIGS. 2-4 show that wings 11-12 have inward-down-sloping upper surfaces 31-32, to self-center rounded products of various sizes atop floor 10. Floor 10 and wings 11-12 are molded as a one-piece tray 6.

FIGS. 2-3 are exploded views, showing pusher 40.

Figure 6:
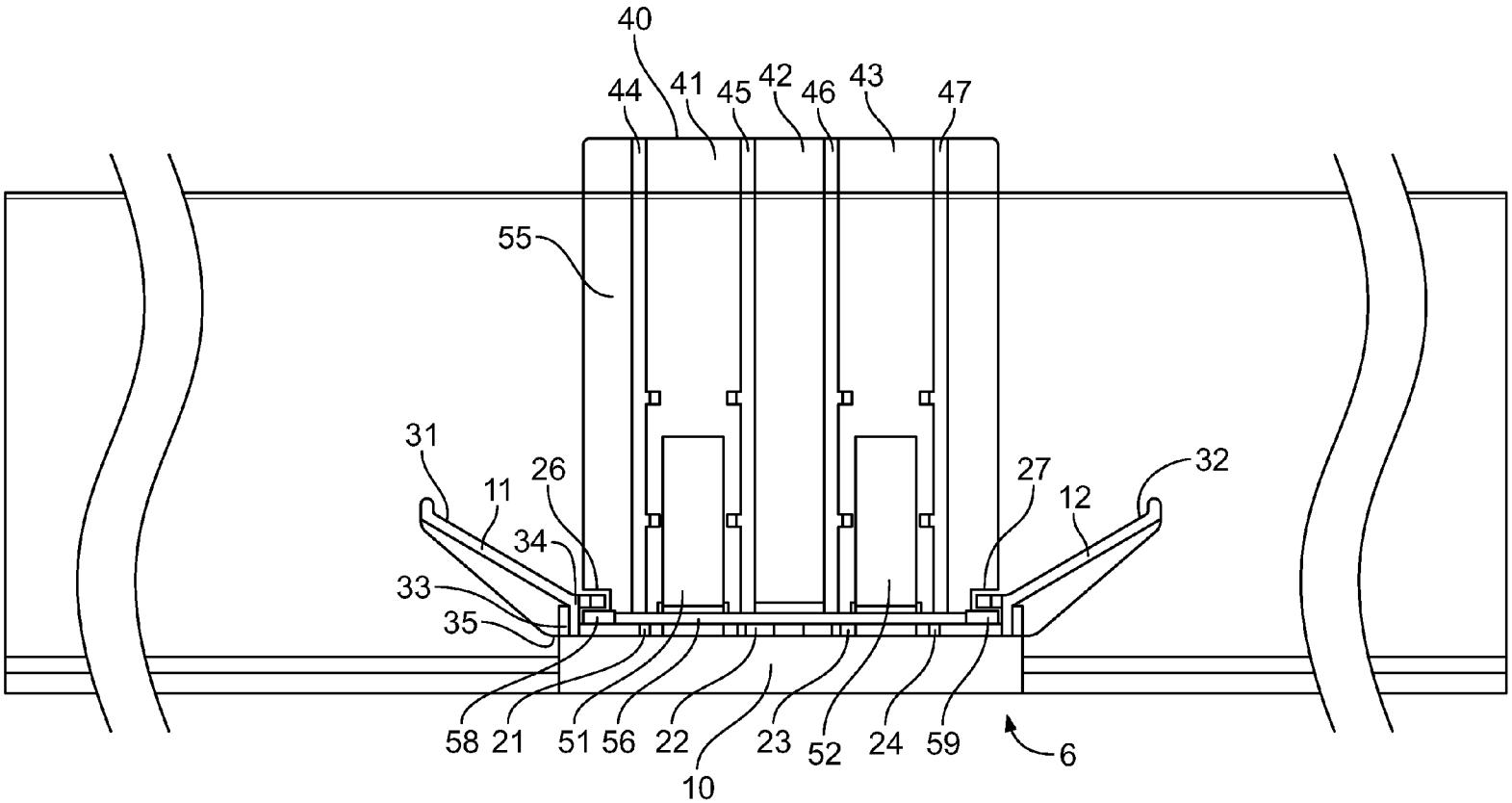
FIG. 6 is rear elevation of a tray and pusher.

FIGS. 6 & 7 show pusher 40 having three triangular spring compartments 41, 42, 43, defined by four walls 44-47.

FIG. 5A shows a top plan view of an embodiment having three springs 51, 52, and 53.

Figure 8:
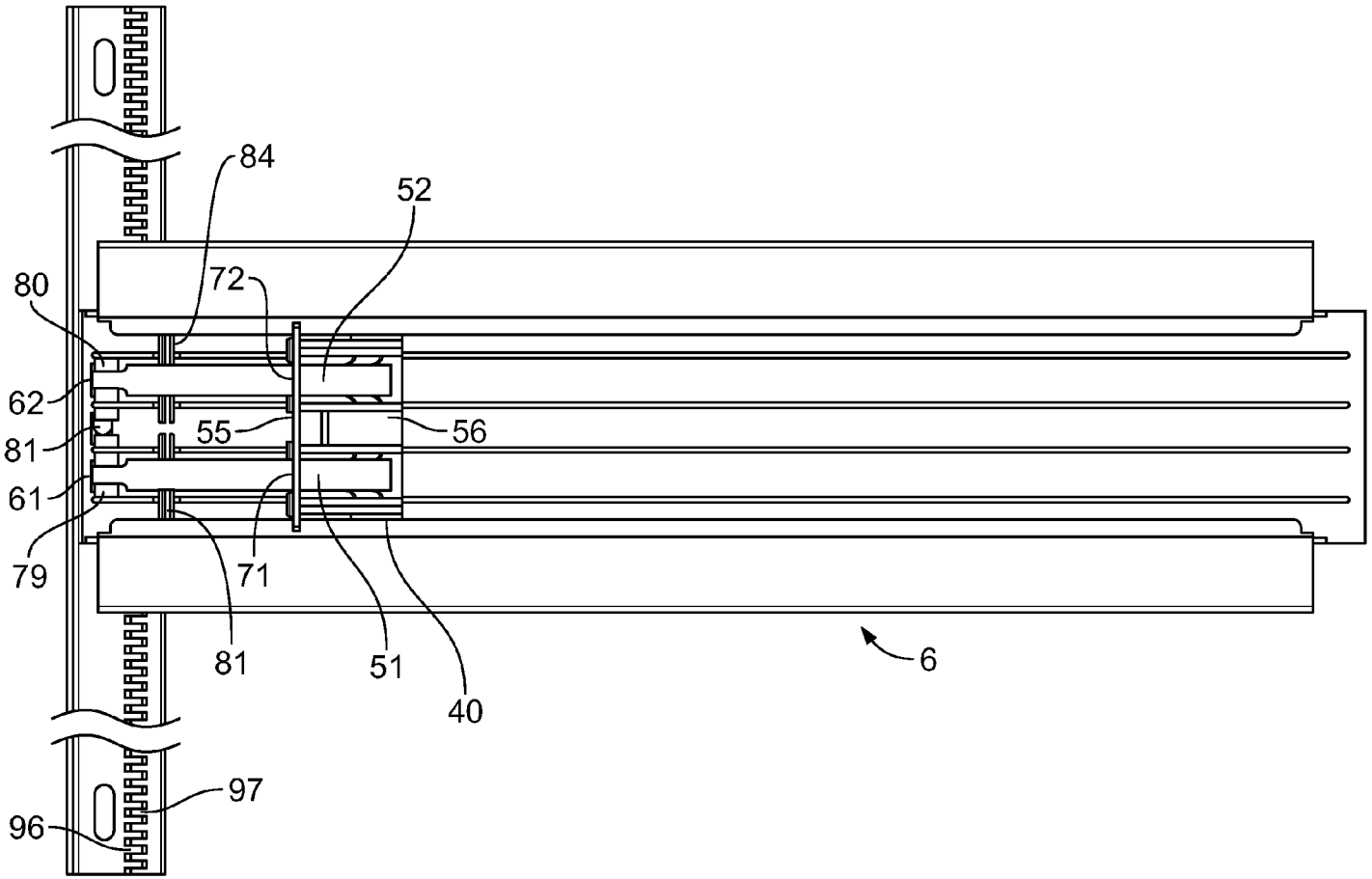
FIG. 8 is a top plan view.

FIGS. 6-8 show a pair of springs 51-52 in compartments 41 and 43. But alternatively a single spring 53 [FIG. 9] may be used instead, spring 53 being, in such case, located in compartment 42 [FIGS. 6-7].

In FIG. 7, pusher 40's walls 44-47 join and triangulate front pusher surface 55 to pusher floor 56. Pusher floor 56's edges 58-59 slide under and engage beneath hold-down channels 26-27 to hold pusher 40 to tray 6 [FIGS. 6-8].

FIG. 6 and FIG. 8 shows ends 61-62 of springs 51-52, which springs 51-52 extend through slots 71-72 (FIG. 8) in front pusher surface 55. Tapers 73-74 (FIGS. 3 & 6) near spring-ends 61-62 allow the spring-ends 61-62 to be inserted in attachment slots 79-80 (FIG. 8). Springs 51-52 then bias pusher 40 towards the front rail. (FIGS. 3-4).

Figure 1:
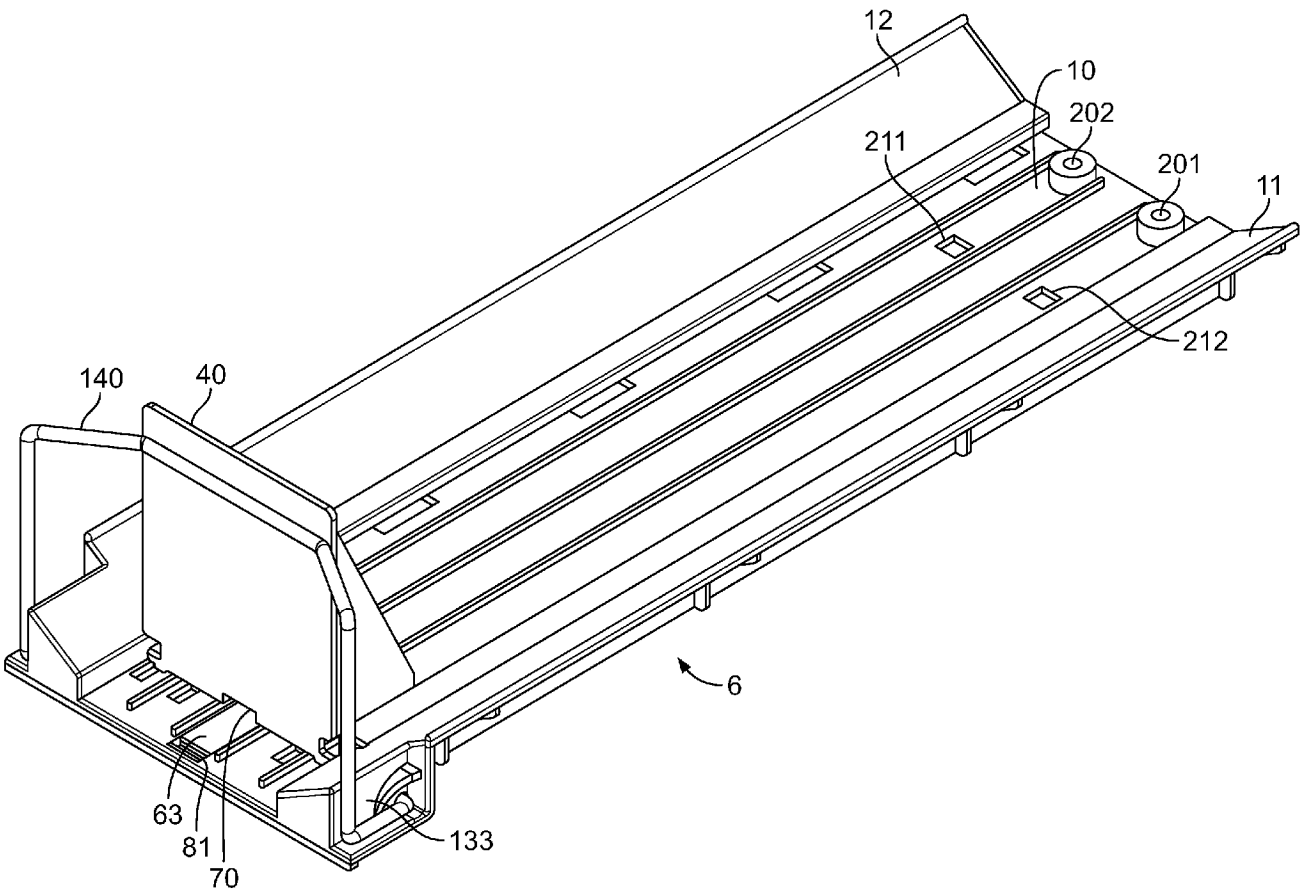
FIG. 1 is an oblique upper right front view of the present invention.

FIGS. 1 & 5 show single spring 53's spring-end 63, similarly mounted through pusher slot 70, to attachment slot 81, but in an alternate single spring embodiment.

Figure 9:
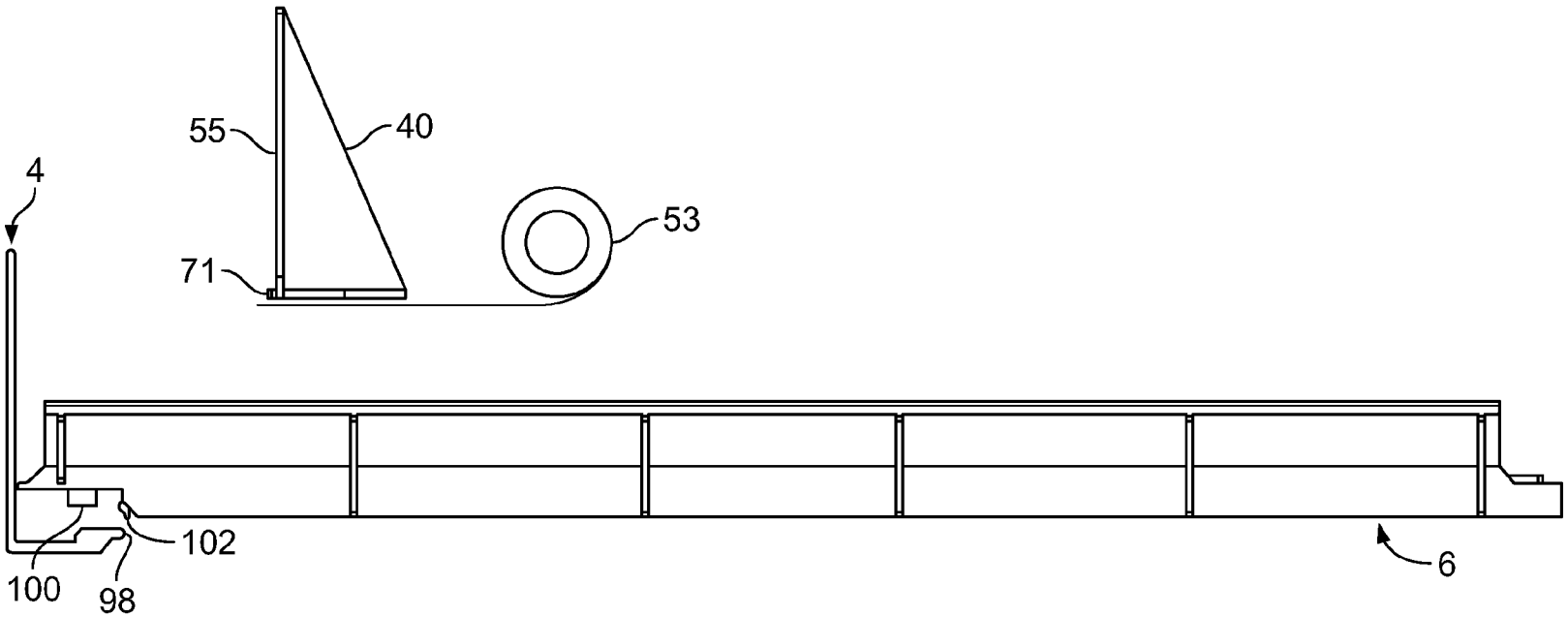
FIG. 9 is a right elevation.

As in FIGS. 7-9, front rail 4 is L-shaped in clear flexible plastic, mountable to the shelf using screws and pins, not shown, through screw slots 91-94 (FIG. 7), also allowing tongues 102 in pairs to rigidly hold and locate trays 6 of various widths. A front rail 4 may be provided in which clear front wall 95 is omitted and a flat track comprising only the bottom leg "_" of the "L" may be installed if vertical shelf clearance is an issue.

As in FIGS. 7-8, front rail 4 includes a sequence of slots 96 and tabs 97 (FIG. 8) for longitudinally locating tabs 100 (FIG. 9) of tray 6 or trays, or dividers (not shown) in ¼" increments.

Front rail back edge 98 is a continuous raised lip for snap-locking and locating trays 6 at any location.

FIG. 8 shows rail 4 which features a single forward-facing row of slots 96 in ¼" increments of fixed depth. Slots 96 are three-sided.

Trays 6, of injection-molded plastic, feature multiple vertical tabs 100 [FIG. 9] on the bottom side, typically two or four tabs per tray 6.

As in FIG. 9, trays 6 include one or more tongues 102 extending vertically beneath each tray 6, facing forward and located behind the referenced tabs 100.

As in FIG. 9, trays 6 are positioned perpendicularly to rail 4, by tabs 100 engaging rail slots 96 (FIG. 8) and by tongue 102 pressed against the rail back edge 98.

Trays 6 are held in position tension by the spring force of the tongue 102 opposing the tabs 100.

This feature combination provides for rigid control of the Tray 6 location and rotation in the horizontal plane.

This feature design also allows flexible freedom of rotation in the vertical plane from front to back. Thus the front rail can tilt forward or back during use without stress or loss of attachment.

Tracks are installable from both the vertical and forward-tilted orientations to allow easy installation and removal.

Tracks may include vertical dividers [not shown] mounted along one or both sides to control products on either side. The wings generally make such dividers unnecessary.

Wire Form

FIGS. 1-3 & 5 show an embodiment including a steel wire-form 140. The wire-form 140 serves to retain the product stack, held in position by the spring-actuated pusher 40, replacing the barrier function of the clear front rail 4. But the clear front rail 4 may be used with the wire-form 140.

As in FIG. 1-3 the wire-form 140, comprises:

a pair of ends 146-147;

a pair of feet 148-149;

a pair of verticals 150-151; and a top 152.

A pair of circular ramps, 161-(162 hidden) are on the outside tray surfaces 133. Surfaces 133 have center holes 163 that locate ends 146-147, that serve as pivot pins for wire form 140. Ramps 161-162 are ramped to spread feet 148-149 apart when the legs 150-151 are pushed back to horizontal by product being loaded onto tray 6. The spring bias of wire-form 140 forces feet 148-149 downward to spring bias verticals 150-151 to return toward a vertical orientation, after the product has been loaded onto tray 6.

The wire 140 would be about 0.125" dia and allow 90 degree rotation, pivoting in the Tray 6 from vertical to in-contact, with Tray 6. Track edge surface 133 would have symmetric holes 163 (made with shutoffs or cams). Each hole 163 features a ramp 161-162 on the outside that spreads the wire-form 140 to the outside as it rotates. This causes the wire-form 140 to spring back to the front as in FIGS. 1 & 5, when wire-form 140 is released.

Thus, a stock person, who is loading the tray 6 from the front, can simply push on the wire-form 140, forcing it down towards floor 10 to clear the product such as plates being loaded onto the Tray 6. When the plates have cleared the wire-form 140, it springs back to the vertical position, and the plates can be released, to be pushed by pusher 40 towards the front, and held against wire form 140 in the vertical position.

Figure 10:
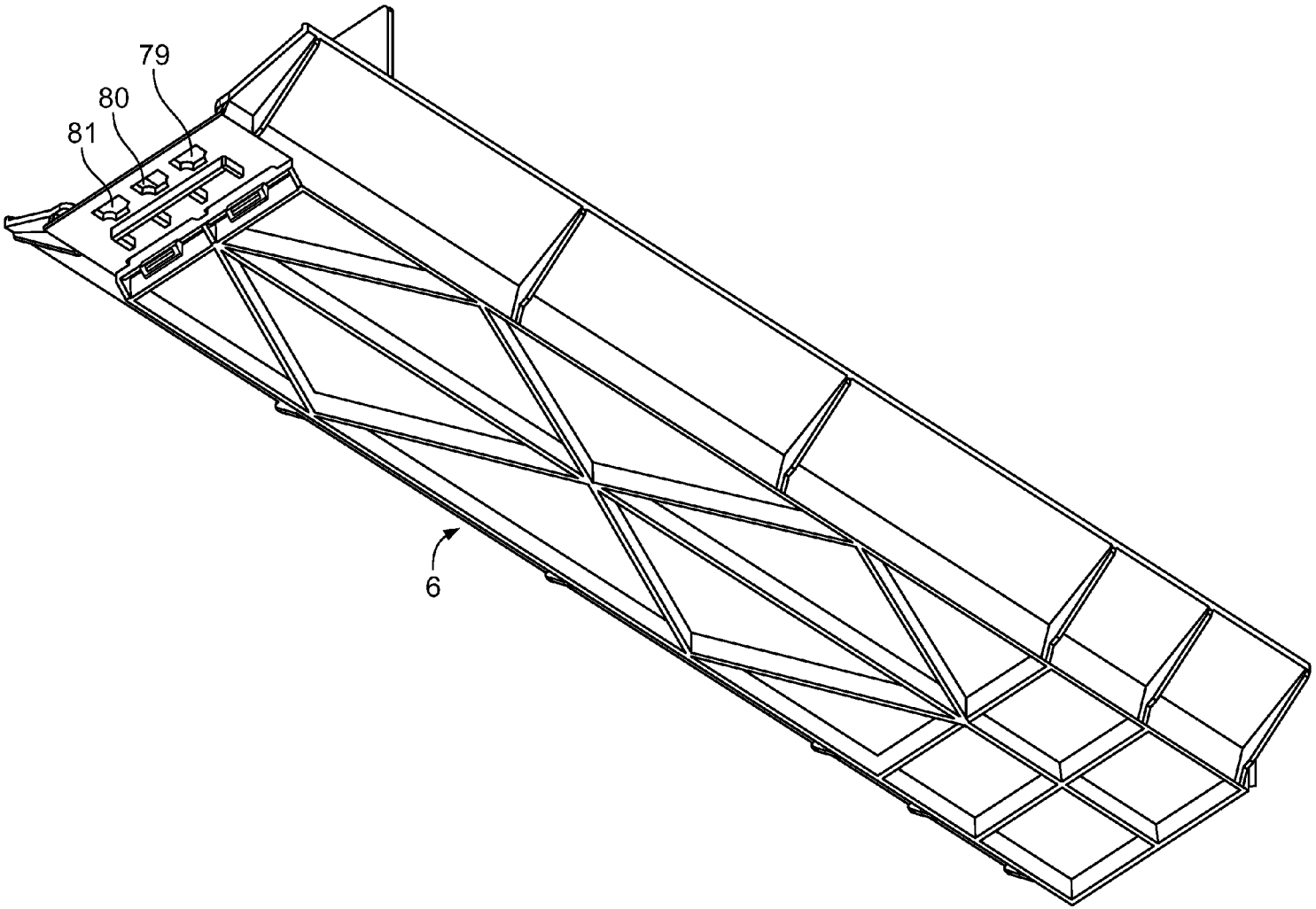
FIG. 10 is a bottom left oblique view of a pusher tray.

FIG. 10 an underside of Pusher-Track system 6. It shows attachment slots 79-80-81; tabs 100; and a pair of tongues 102.

FIG. 1 shows stops 201-202, which prevent pusher 40 leaving track tray 6 after installation. In FIG. 1, stops 201-202 are a pair of one-way fingers molded to the back of tray floor 10.

Alternatively, spring finger stops such as 206-7 in FIG. 3 may be provided as in FIG. 3. Stops 206-207 may be inserted into pairs of holes such as pair 211-212 and pair 213-214.

This system is adaptable for various depths of shelving. These include but are not limited to embodiments in lengths of 16" 18", & 20". The 18" version is made by including a mold insert. The 16" and 20" tracks are versions of the 18" and 22" tracks after cutting 2" from the back. Stops are made by hand-pressing a pair of snap-in plastic grommets 206-207 into mating square holes such as 211-214 of the track floor 10.

Most of the figures depict the tray assembly 6 scaled to an 18" insert-molded length for illustration.

Figure 11:
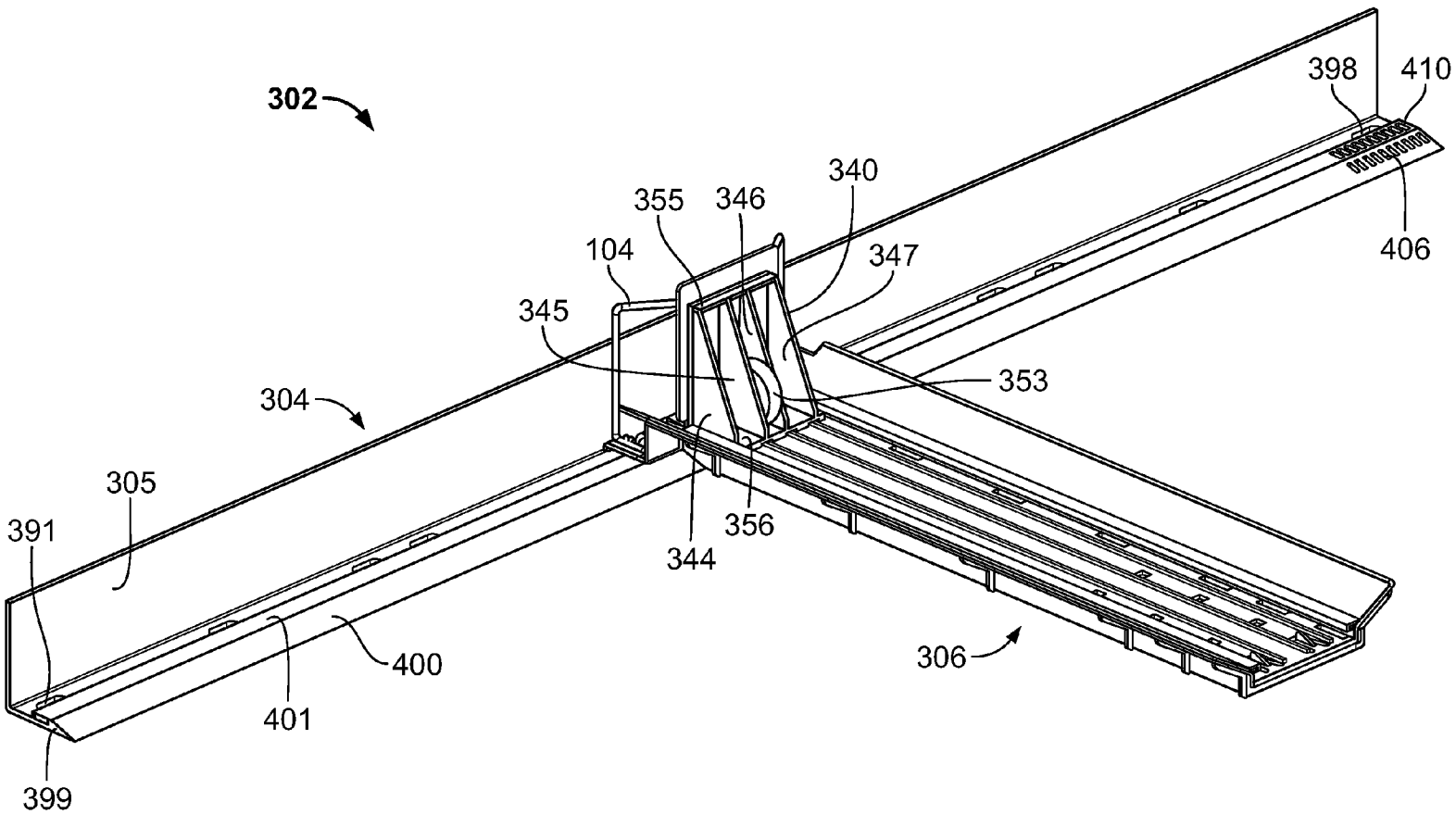
FIG. 11 is an oblique upper right rear view of a presently preferred embodiment of the present invention.

FIG. 11 show a an alternate and presently preferred way of attaching a tray to the shelf. A shelf pusher system, generally designated 302, has a clear front rail 304 and spring-powered pusher-track tray 306 for merchandising objects such as plates, without a back rail or integral divider.

As noted above, the front wall 305 of this front rail 304 may be omitted from some supplied front rails, where shelf clearance is an issue.

Figure 12:
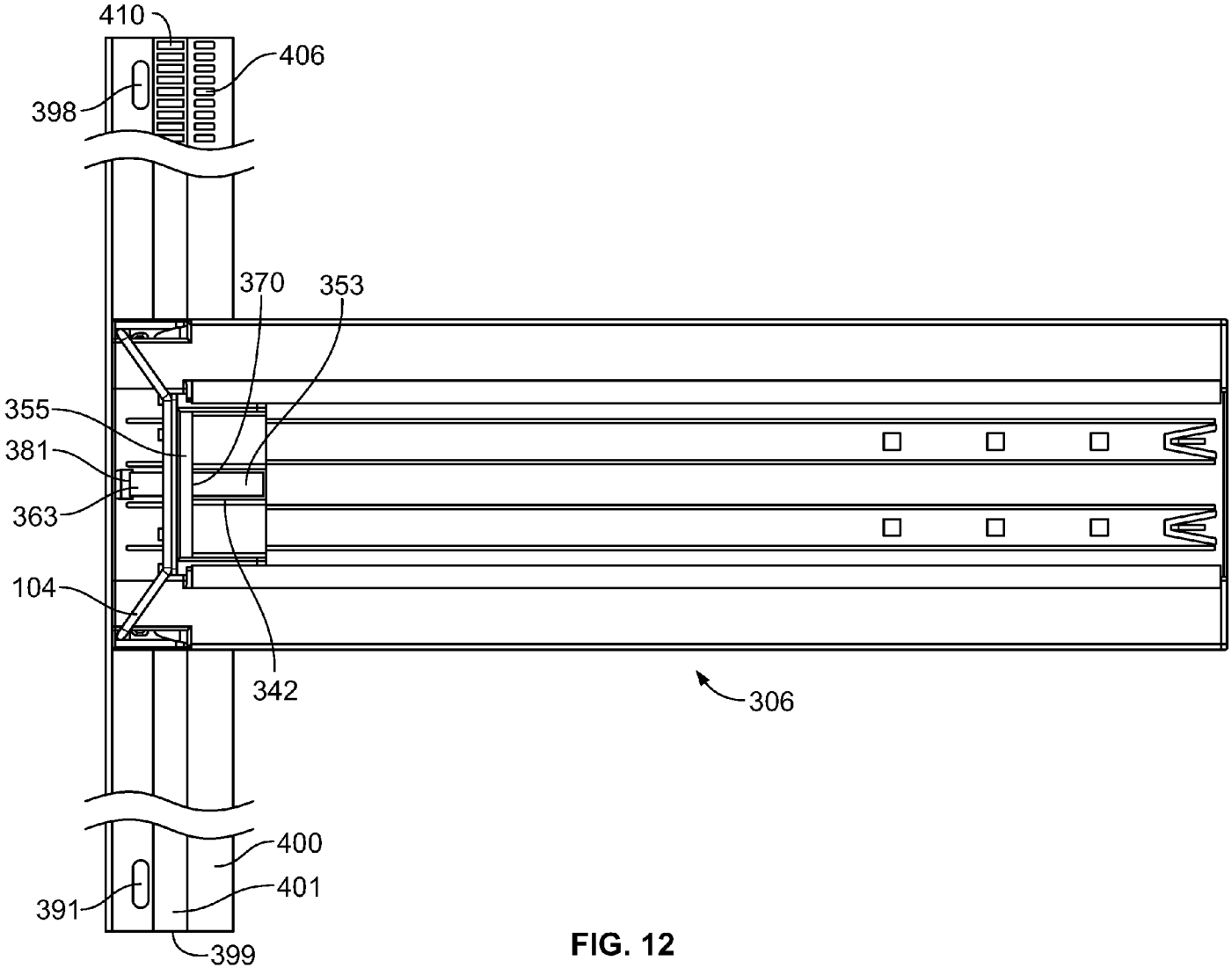
FIG. 12 is a top plan view thereof.

FIGS. 11 & 12 show tray 306. Pusher 340 is mounted thereon, having a single spring 353 which has spring-end 363, similarly mounted through pusher slot 370, to attachment slot 381, in a single spring embodiment.

FIGS. 11-12 shows a single spring 353 in compartment 342. But alternatively a pair of pusher springs, as previously described, may be used.

In FIG. 11, pusher 340's walls 344-347 join and triangulate front pusher surface 355 to pusher floor 356.

Figure 14:
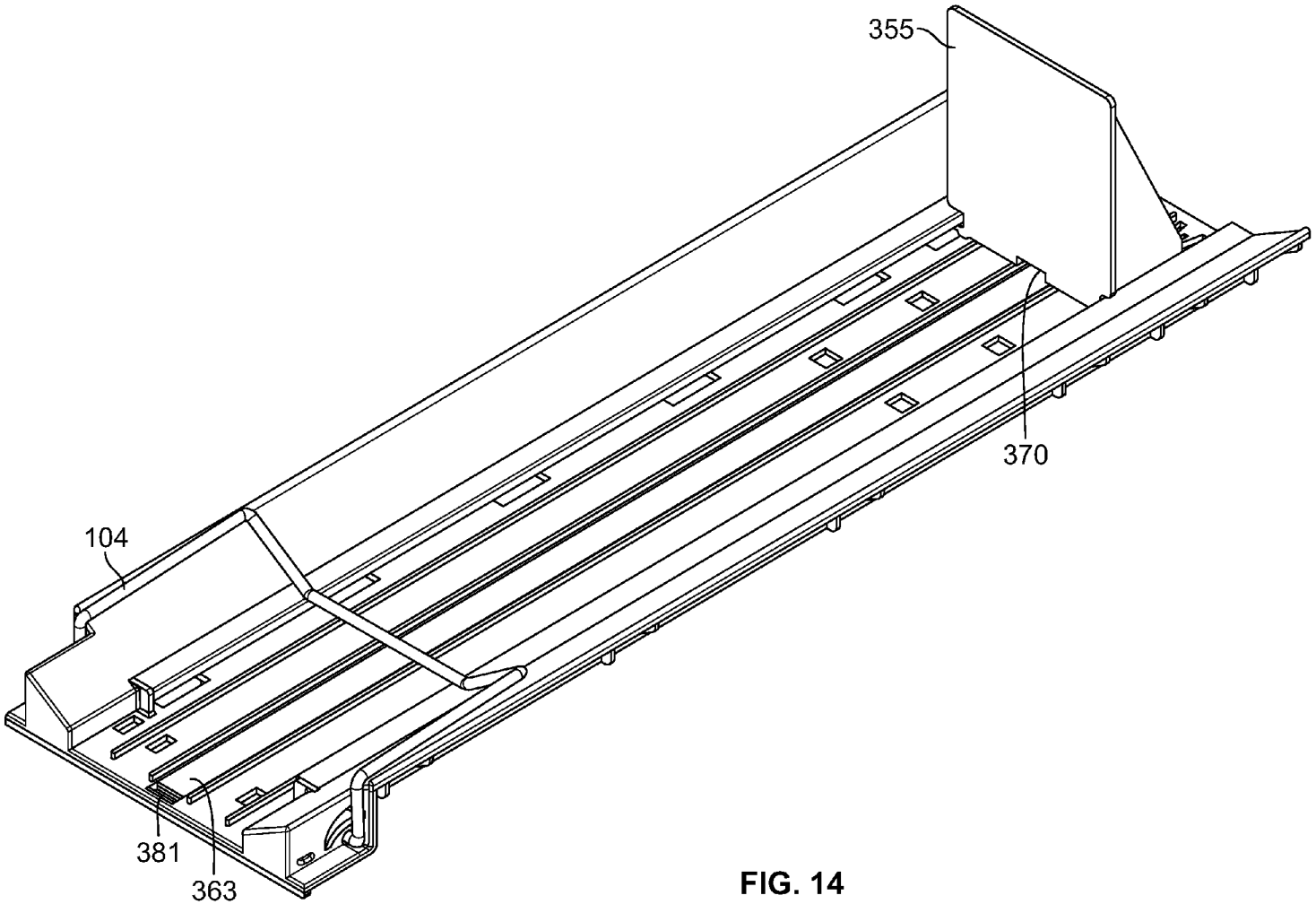
FIG. 14 is a right oblique view thereof from the upper front of a pusher tray.

FIG. 14 shows slot 370 in front pusher surface 355. Spring-end 363 may be hooked on the edge of slot 381. Springs 353 then biases pusher 340 towards front rail 304.

As in FIG. 11, front rail 304 is L-shaped in clear flexible plastic, mountable to the shelf using screws and pins, not shown, through screw slots 391-98 (FIG. 11), in L-floor 399. L-floor 399 has a ramp 400 and plateau 401.

In FIG. 11, slots 406 & 410 are shown on the right, but in the production version of floor 399, slots 406 extend the length of ramp 400 and slots 410 extend the length of plateau 401.

Figure 13:
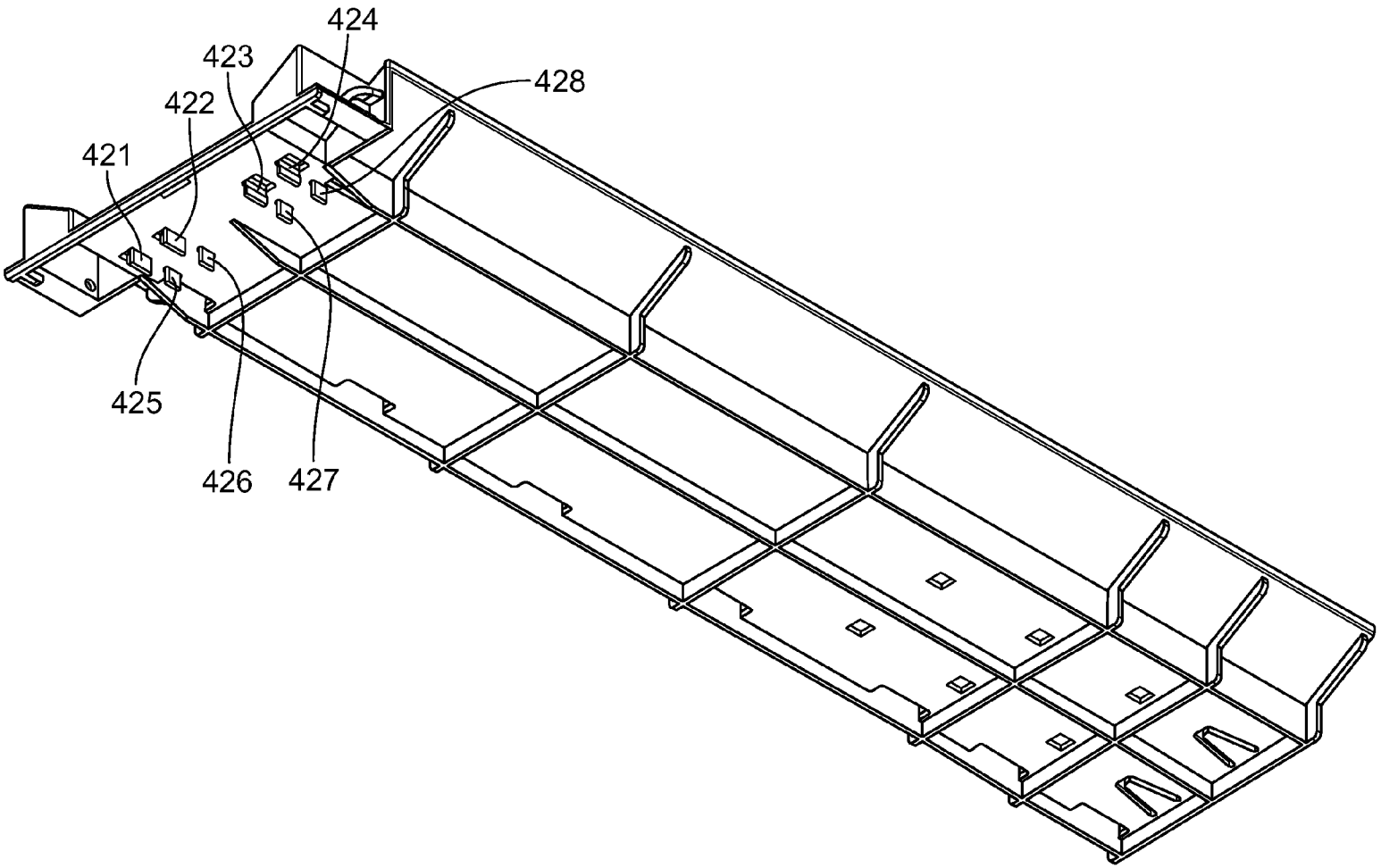
FIG. 13 is a oblique view thereof from the lower right front.

FIG. 13 shows tabs 421-428 which engage slots 410 and 406, at any desired location along floor 399 to rigidly hold and locate trays 306 of various widths and at various horizontal spacings. FIGS. 11, 12 & 14 also show a front retaining wire 104, which works similarly to wire 104 described in FIGS. 1-3.

I claim:

1. A pusher system, for merchandising products, said pusher system comprising:

a tray; said tray comprising a floor, and a pair of wings, configured to hold the products centered on the tray; a pusher slidably mounted on said floor; a spring configured to bias said pusher customerward, thereby propelling the products customerward; and a customerward barrier configured to hold the products, which are forced against said customerward barrier by the pusher; wherein said pair of wings have inward-down-sloping upper surfaces, to self-center the products atop said floor; and said wings are molded together with the floor;

a channel comprises a protruding continuous undersurface for slidably retaining the pusher to the floor; the wings comprise a plurality of rail-mount tabs; said rail-mount tabs are configured to mount the hold-down channel to the wings; the channel snaps onto the rail-mount tabs.

2. A pusher system, according to claim 1, in which said floor comprises a plurality of floor rails which slidably support the pusher and the products, and provide clearance for locating an uncoiled portion of the spring.

3. A pusher system, according to claim 2, in which the customerward barrier is a clear plastic fence mounted at a customerward edge of the shelf, a front rail has a back edge, which is a continuous raised lip for snap-locking and locating the tray at any location.

4. A pusher system, according to claim 1, in which: the customerward barrier is a springable metal wire form.

5. A pusher system, according to claim 4, in which:

the springable metal wire-form, comprises: a pair of ends; a pair of feet; a pair of verticals; and a top.

6. A pusher system, according to claim 1, in which: said products have a curved circumference; and said pair of wings are configured to center and hold said products centered on the tray.

7. A pusher system, according to claim 6, in which: said pair of wings are also configured to adapt the pusher system to curved circumference products of differing circumferences and curvatures, without changing a tray width.

8. A pusher system, for merchandising products, said pusher system comprising:

a tray; said tray comprising a floor, and a pair of wings, configured to hold the products centered on the tray; a pusher slidably mounted on said floor; a spring configured to bias said pusher customerward, thereby propelling the products customerward; and a customerward barrier configured to hold the products, which are forced against said customerward barrier by the pusher; wherein said pair of wings have inward-down-sloping upper surfaces, to self-center the products atop said floor; and said wings are molded together with the floor; the customerward barrier is a springable metal wire form; the springable metal wire-form, comprises: a pair of ends; a pair of feet; a pair of verticals; and a top; the wire-form's ends serve as pivot pins, said pivot pins are located into center holes on side surfaces of the tray; said pivot pins pivotably mount the wire form; a pair of circular ramps, are on outside tray surfaces; said ramps are ramped to spread the feet apart when the legs are pushed back to horizontal by products being loaded onto tray; and so that the spring bias of wire-form forces feet downward, to spring bias the verticals to return toward a vertical orientation, after the products have been loaded onto the tray.

9. A pusher system, for merchandising plates, said pusher system comprising:

a tray; said tray comprises a floor, said floor having affixed to both sides a pair of wings to hold plates centered on the tray; a pusher is slidably mounted on said floor; a spring biases said pusher customerward, thereby propelling the plates customerward; a customerward barrier holds the plates, which are forced against said customerward barrier by the pusher; a channel comprises a protruding continuous undersurface for slidably retaining the pusher to the floor; the wings comprise a plurality of rail-mount tabs; said rail-mount tabs are configured for mounting the channel to the wing, in which the channel snaps onto the rail-mount tabs; the pusher has three triangular spring compartments defined by four walls; the channel slidably supports the pusher and the plates, and provides clearance for locating an uncoiled portion of the spring; and the customerward barrier and is configured to rotate from vertical, to being in contact with the channel, to provide clearance for inserting the plates onto the tray.

10. A pusher system, according to claim 9, in which:

a mounting track is located at a customerward edge of the shelf, said mounting track has a back edge, which is a continuous raised lip for snap-locking and locating the tray at any location along said mounting track.

11. A pusher system, for merchandising products, said pusher system comprising:

a tray; wherein the tray comprises a floor, having affixed to both sides a pair of wings to hold the products centered on the tray; a pusher which is slidably mounted on said floor; a spring which is configured to bias said pusher customerward, thereby propelling the products customerward; and a customerward barrier configured to hold the plates, which are forced against said customerward barrier by the pusher; a channel comprises a protruding continuous undersurface for slidably retaining the pusher to the floor; wherein the wings, comprise a plurality of rail-mount tabs; wherein said rail-mount tabs are for mounting a channel to the wings, in which the channel snaps onto the rail-mount tabs; a plurality of openings facilitate the formation of the rail-mount tabs in the process of molding the tray; wherein the pusher has three triangular spring compartments, defined by four walls; wherein said spring is configured to coil into and out of a central compartment of the three spring compartments; the channel slidably supports the pusher and the product, and provides clearance for locating an uncoiled portion of the spring; wherein the customerward barrier comprises: a pair of pivot pins; said pivot pins are located into center holes on side surfaces of the tray; said pivot pins pivotably mount the customerward barrier; a pair of circular ramps, are on the side surfaces of the tray; said ramps are ramped to spread the pivot pins apart in a horizontal customerward barrier configuration to spring bias the customerward barrier to return to a vertical orientation, after the plates have been loaded onto the tray; the customerward barrier comprises steel, of 0.125" diameter and the customerward barrier rotates 90 degrees, between a vertical position and a horizontal position, to provide clearance for inserting the plates onto the tray; a mounting track, which is located at a customerward edge of the shelf, said mounting track has a back edge, which is a continuous raised lip for snap-locking and locating the tray at any location along said mounting track.

12. A method of merchandising products on a shelf, said method comprising the steps of:

providing a pusher system by: molding a tray comprising a floor, having affixed to both sides a pair of wings, forming openings and rail-mount tabs, in the molding of the tray; mounting a pusher slidably on said floor; mounting a coiled spring to bias the pusher customerward; holding down the pusher by mounting a channel, by snapping the channel onto the tabs; mounting a customerward barrier, comprising a pair of pivot pins, on said pivot pins, at a customerward end of the tray; locating a mounting track at the customerward edge of the shelf, said mounting track having a back edge, which is a continuous raised lip; snap-locking and locating the tray at any location along said mounting track; loading the products onto the tray by pressing the products inward against the customerward barrier, thus pivoting said customerward barrier on the pair of pivot pins, to lay said customerward barrier flat against the channel to pass the products past the customerward barrier, causing a pair of ramps to spread the pivot pins apart against a centerward spring bias of the customerward barrier; the wings centering the products on the tray; pushing the products against the pusher back against a coiled spring bias of the coiled spring, to clear; the customerward barrier; wherein the centerward spring bias of said customerward barrier forces the pair of feet downward, to spring bias of said customerward barrier to return a vertical orientation, after the products have been loaded onto the tray; releasing the products; and thereby causing the spring bias of the pusher to push the products back against the barrier, and to clamp the products against the barrier, where the products can be seen and removed, one-at-a-time, by the customer.

* * * * *